US008840773B2

(12) United States Patent
Wang

(10) Patent No.: US 8,840,773 B2
(45) Date of Patent: Sep. 23, 2014

(54) RECLAIMING METAL FROM ARTICLES

(75) Inventor: Wusheng Wang, Shanghai (CN)

(73) Assignee: Empire Technology Development LLP, Wilmington, DE (US)

( * ) Notice: Subject to any disclaimer, the term of this patent is extended or adjusted under 35 U.S.C. 154(b) by 215 days.

(21) Appl. No.: 13/579,927

(22) PCT Filed: Jun. 17, 2011

(86) PCT No.: PCT/CN2011/075843

§ 371 (c)(1),
(2), (4) Date: Aug. 18, 2012

(87) PCT Pub. No.: WO2012/171209

PCT Pub. Date: Dec. 20, 2012

(65) Prior Publication Data

US 2013/0037418 A1 Feb. 14, 2013

(51) Int. Cl.

| | |
|---|---|
| ***C25C 1/12*** | (2006.01) |
| ***C25C 7/02*** | (2006.01) |
| ***C25C 7/00*** | (2006.01) |

(52) U.S. Cl.

CPC .. *C25C 1/12* (2013.01); *C25C 7/002* (2013.01)
USPC ..... 205/772; 205/576; 204/213

(58) Field of Classification Search

None
See application file for complete search history.

(56) References Cited

U.S. PATENT DOCUMENTS

| | | | | |
|---|---|---|---|---|
| 4,096,053 | A * | 6/1978 | Emmett et al. | 204/238 |
| 4,123,340 | A * | 10/1978 | Kammel et al. | 210/665 |
| 5,755,950 | A * | 5/1998 | Bell | 205/445 |
| 6,322,685 | B1 | 11/2001 | Kang et al. | |
| 6,372,111 | B1 * | 4/2002 | Watts | 205/101 |
| 7,790,016 | B2 | 9/2010 | Ur Rahman et al. | |
| 8,366,903 | B2 * | 2/2013 | Kawamura et al. | 205/674 |
| 2008/0206567 | A1 * | 8/2008 | Min et al. | 428/404 |

FOREIGN PATENT DOCUMENTS

| | | |
|---|---|---|
| AT | 387590 B | 2/1989 |
| BE | 903054 A1 | 12/1985 |

(Continued)

OTHER PUBLICATIONS

Imre-Lucaci et al, Copper Recovery from Real Samples of WPCBs by Anodic Dissolution, Environmental Engineering and Management Journal, vol. 11, No. 8, Aug. 2012, pp. 1439 (abstract only).*

(Continued)

*Primary Examiner* — Harry D Wilkins, III
(74) *Attorney, Agent, or Firm* — Pepper Hamilton LLP

(57) ABSTRACT

Techniques and systems for reclaiming metals from articles having one or more components containing or coated with copper are provided. An example technique may include providing an article having one or more components containing or coated with copper, providing a barrel disposed in a container, the container containing an electrolytic solution and a copper starting pole component, positioning a plurality of electrically conductive particles and the article within the barrel, and separating one or more copper ions from at least a portion of the article by electrolysis.

26 Claims, 9 Drawing Sheets

(56) References Cited

FOREIGN PATENT DOCUMENTS

| | | | |
|---|---|---|---|
| BR | 8503833 | A | 5/1986 |
| CN | 85106153 | A | 3/1987 |
| CN | 1036805 | A | 11/1989 |
| CN | 101519791 | A | 9/2009 |
| CN | 101538722 | A | 9/2009 |
| DE | 3429902 | A1 | 2/1986 |
| DE | 19635039 | C1 | 1/1998 |
| FR | 2569205 | A1 | 2/1986 |
| GB | 2163101 | A | 2/1986 |
| IT | 1185341 | B | 11/1987 |
| JP | 62-264752 | | 11/1987 |
| NL | 8502245 | A | 3/1986 |
| SE | 8503594 | A | 2/1986 |

OTHER PUBLICATIONS

Veit et al Recovery of copper from printed circuit boards scraps by mechanical processing and electrometallurgy, Journal of Hazardous Materials, vol. B137, 2006 (no month), pp. 1704-1709.*

Tison, Richard P., Copper Recovery Using a Tumbled-Bed Electrochemical Reactor, Journal of the Electrochemical Society: Electrochemical Science and Technology, Feb. 1981, pp. 317-322.*

International Search Report and Written Opinion for PCT/CN2011/075843 dated Mar. 22, 2012.

* cited by examiner

RECLAIMING METAL FROM ARTICLES

CLAIM OF PRIORITY

This application is a U.S. national stage filing under 35 U.S.C. §371 of International Application No. PCT/CN2011/075843, filed Jun. 17, 2011 and entitled "Reclaiming Metal From Articles," the disclosure of which is incorporated by reference in its entirety.

BACKGROUND

The present disclosure generally relates to reclaiming metal from articles, and, more particularly, to reclaiming metals from articles having one or more components containing or coated with copper.

SUMMARY OF THE DISCLOSURE

A first aspect of the present disclosure generally describes methods of reclaiming metals. Example methods may include providing an article having component(s) containing or coated with copper, and providing a barrel disposed in a container containing an electrolytic solution and a copper starting pole component. Example methods may also include positioning a plurality of electrically conductive particles and the article within the barrel, and separating copper ion(s) from at least a portion of the article by electrolysis A second aspect of the present disclosure generally describes methods of reclaiming metals. Example methods may include providing one or more articles, each respective article containing at least one component containing or coated with copper, and providing an electrolytic bath adapted to receive a porous plating barrel, an electrolytic solution and a copper starting pole component. The plating barrel may be adapted to receive the one or more articles and a plurality of electrically conductive particles. Example methods may also include positioning the one or more articles and at least a portion of the plurality of electrically conductive particles in the plating barrel, and positioning the plating barrel in the electrolytic solution. Example methods may even further include separating copper ion(s) from at least one of the articles into the electrolytic solution using an electrolysis process, and receiving at least one of the one or more separated copper ions by the copper starting pole component.

A third aspect of the present disclosure generally describes methods of reclaiming metals. Example methods may include providing circuit board(s), each respective circuit board having a copper component disposed thereon, and providing an electrolytic bath adapted to receive a porous plating barrel, an electrolytic solution and a copper starting pole component. The plating barrel may be adapted to receive the circuit board(s) and a plurality of electrically conductive particles, and may be further adapted to allow the electrolytic solution to enter and exit the plating barrel. Example methods may also include positioning the electrolytic solution in the electrolytic bath, and positioning, in the plating barrel, the circuit board(s) in contact with at least a portion of the electrically conductive particles. Example methods may also include positioning the plating barrel and copper starting pole component in the electrolytic bath, and biasing the plating barrel with a positive voltage relative to a voltage of a copper starting pole component to facilitate transfer of one or more copper ions from the at least one copper component to the copper starting pole component via electrolysis. Example methods may further include rotating the plating barrel within the electrolytic bath to facilitate exposure of the at least one copper component to the electrolytic solution and the portion of the electrically conductive particles.

A fourth aspect of the present disclosure generally describes reclaimed copper materials produced by an example method that includes providing an article having one or more components containing or coated with copper, and providing a barrel disposed in a container containing an electrolytic solution and a copper starting pole component. Example methods may includes positioning a plurality of electrically conductive particles and the article within the barrel, and separating one or more copper ions from at least a portion of the article by electrolysis.

A fifth aspect of the present disclosure generally describes reclaimed copper materials produced by an example method that includes providing one or more articles, each respective article containing at least one component containing or coated with copper, and providing an electrolytic bath adapted to receive a porous plating barrel, an electrolytic solution and a copper starting pole component, where the plating barrel is adapted to receive the one or more articles and a plurality of electrically conductive particles. Example methods may include positioning the one or more articles and at least a portion of the plurality of electrically conductive particles in the plating barrel, and positioning the plating barrel in the electrolytic solution. Example methods may further include separating one or more copper ions from at least one of the one or more articles into the electrolytic solution using an electrolysis process, and receiving at least one of the one or more separated copper ions by the copper starting pole component.

A sixth aspect of the present disclosure generally describes reclaimed copper materials produced by an example method that includes providing one or more circuit boards, each respective circuit board having a copper component disposed thereon, and providing an electrolytic bath adapted to receive a porous plating barrel, an electrolytic solution and a copper starting pole component. The plating barrel may be adapted to receive the one or more circuit boards and a plurality of electrically conductive particles, and may be further adapted to allow the electrolytic solution to enter and exit the plating barrel. Example methods may also include positioning the electrolytic solution in the electrolytic bath, and positioning, in the plating barrel, the one or more circuit boards in contact with at least a portion of the plurality of electrically conductive particles. Example methods may further include positioning the plating barrel and copper starting pole component in the electrolytic bath, and biasing the plating barrel with a positive voltage relative to a voltage of a copper starting pole component to facilitate transfer of one or more copper ions from the at least one copper component to the copper starting pole component via electrolysis. Example methods may even further include rotating the plating barrel within the electrolytic bath to facilitate exposure of the at least one copper component to the electrolytic solution and the portion of a plurality of electrically conductive particles.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
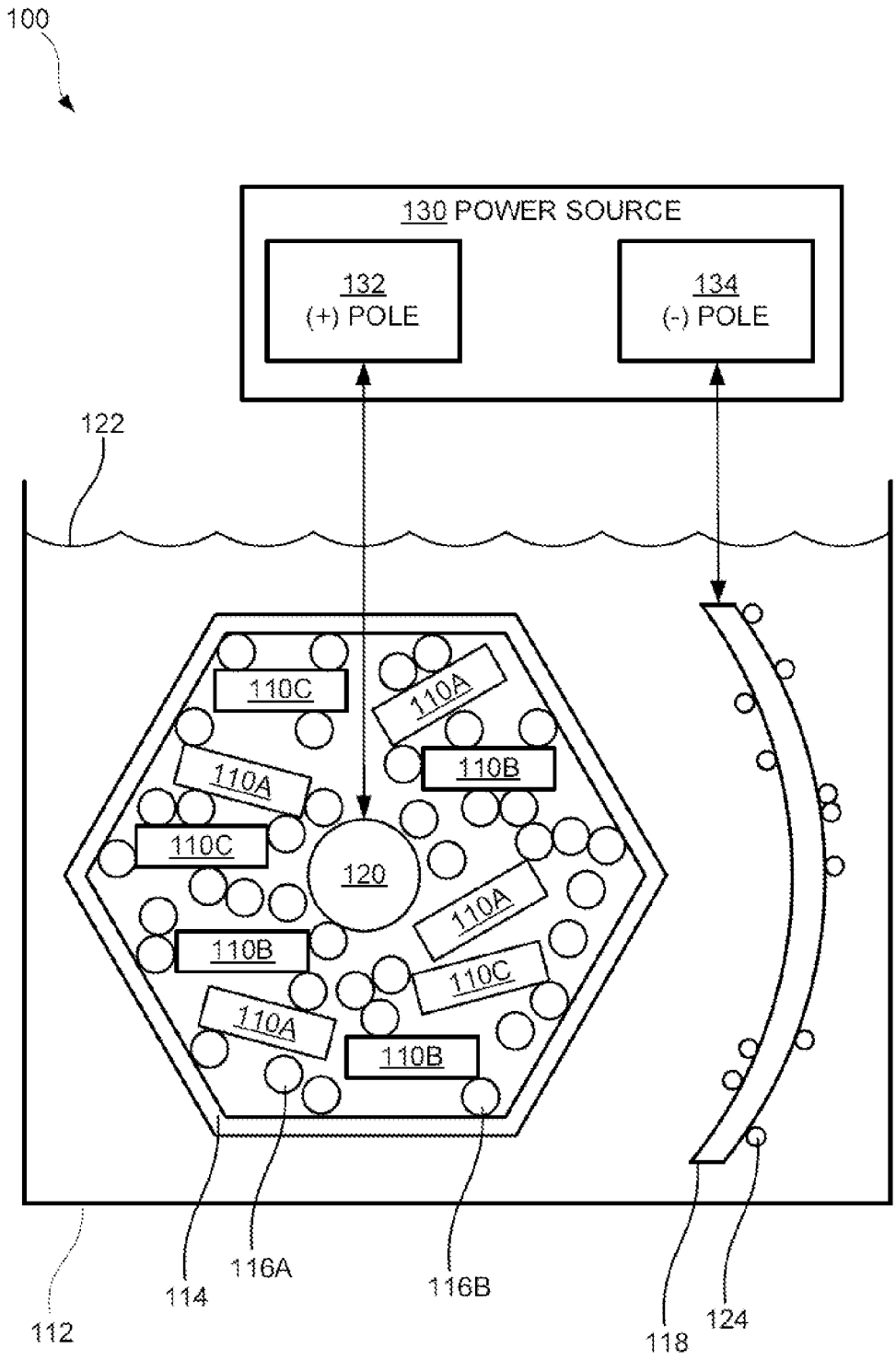
FIG. 1 is a diagram depicting an example environment used in some embodiments of reclaiming metal(s) from articles.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

Methods, systems, apparati and/or materials related to reclaiming metal from articles, and, more particularly, to reclaiming metals from articles having one or more components containing or coated with copper are described.

The present disclosure contemplates that electronic wastes are the fastest growing solid wastes due to the increasing speed of the replacement of the older generations of electronic products. In particular, waste circuit boards may be difficult to treat and/or recycle, as many circuit boards have metal components, including copper components, disposed thereon. For example, many circuit boards include one or more copper foils that may be reclaimed for other uses.

FIG. 1 is a diagram depicting an example environment 100 used in some embodiments of reclaiming metals from articles. Example embodiment 100 includes a plating barrel 114 and a copper starting pole component 118 (e.g., copper starting pole plate), both positioned in an electrolytic bath 112 and immersed in an electrolytic solution 122. The electrolytic solution 122 may be any known electrolytic solution, such as copper sulfate and sulfuric acid and copper chloride and hydrochloric acid. Example concentrations of a copper sulfate and sulfuric acid electrolytic solution 122 may include 35-55 g/L of copper sulfate and 100-200 g/L of sulfuric acid. The plating barrel 114 may have porous walls (e.g., holes or slots in the walls) to allow electrolytic solution 122 to flow in and out of the plating barrel 114. In this manner, articles 110A, 110B, 110C (e.g., circuit boards having metal components disposed thereon) and inert electrically conductive particles 116A, 116B may be in electrical communication with the electrolytic solution 122. In some examples, an inner wall of the plating barrel 114 may have electrical conductive attributes. The plating barrel 114 may be coupled to a positive (+) pole 132 of a power source 130. Such coupling may be between the positive (+) pole 132 and a central shaft 120 of the plating barrel 114. The copper starting pole component 118 may be coupled to a negative (−) pole 134 of the power source 130.

The articles 110A, 110B, 110C and electrically conductive particles 116A, 116B may be located in the plating barrel 114. When the power source 130 is in a conductive state, copper components (e.g., copper foil) disposed on the articles 110A, 110B, 110C may separate from the articles 110A, 110B, 110C and enter the electrolytic solution 122 as copper ions 124 under the conventional principals of electrolysis. When the copper ions 124 enter the electrolytic solution 122, the copper ions 124 may be attracted to the copper starting pole component 118 under the conventional principals of electrolysis. When the copper ions 124 have collected and/or accumulated to a desired thickness on the copper starting pole component 118, the copper starting pole component 118 may be removed from the electrolytic bath 112. In this way, copper components of the articles 110A, 110B, 110C may be electrolyzed into a copper starting pole component 118.

In some examples (as depicted in FIG. 1), the copper starting pole component 118 may be formed as an arc shape to reduce the distance between the copper starting pole component 118 and the plating barrel 114. In this manner, the efficiency of the electrolysis process may be improved. Other shapes and/or arrangements may also be used. In some examples, the distance between copper starting pole component 118 and the plating barrel 114 may be minimized to help minimize voltage loss, thus improving electrolysis efficiency and reducing electricity consumption.

In some examples, the articles 110A, 110B, 110C may include a non-conductive base material having one or more metals (e.g., copper component) disposed thereon or coupled thereto (e.g., printed circuit boards having conductive metal tracks and/or pathways). In an attempt to maximize reclamation of metals, electrically conductive particles 116A, 116B may be used to electrically couple the metal portions of the articles 110A, 110B, 110C to the positively electrically charged plating barrel 114. In some examples, the plating barrel 114 may be rotated and/or rolled in an effort to maximize contact of the metal portions (e.g., copper components) of the articles 110A, 110B, 110C and the positively electrically charged plating barrel 114. In this manner, a greater amount of metal portions may become electrically conductive, thus being separated from the articles 110A, 110B, 110C. Other metals less electrically active than copper (e.g. gold, silver, aurum, platinum, lead) that may be attached to a copper component on an article 110A, 110B, 110C may also separate from the article 110A, 110B, 110C. Such metals may then sink in the electrolytic solution 122 toward a bottom surface of the electrolytic bath 112 to become a silt, and may also be reclaimed. Other metals more electrically active than copper (e.g. zinc, nickel, iron and the like) may enter into the electrolyte as ions, and may be reclaimed by standard electrolyte purification techniques.

Figure 2:
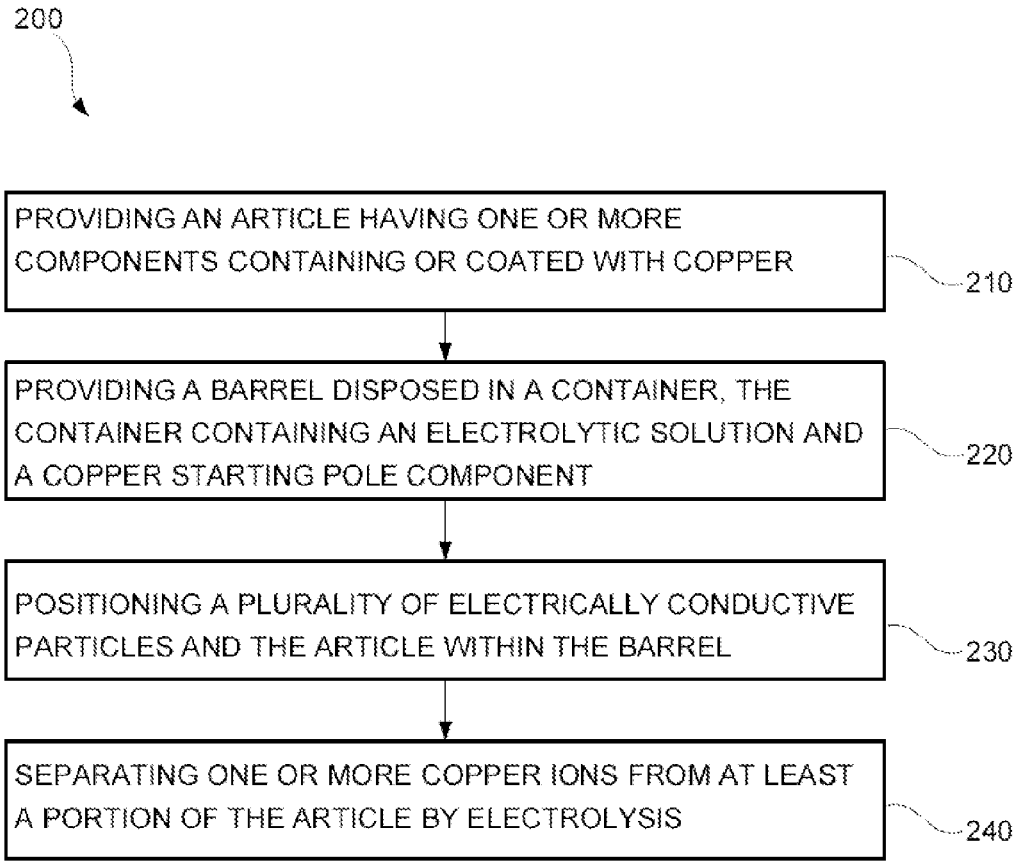
FIG. 2 is a flowchart depicting some example methods of reclaiming metal.

FIG. 2 is a flowchart depicting some example methods 200 of reclaiming metal, in accordance with at least some embodiments of the present disclosure. Example method 200 may include one or more of operations, functions or actions as depicted by blocks 210, 220, 230 and/or 240.

Processing may begin at block 210, by providing an article having one or more components containing or coated with copper. Block 210 may be followed by block 220. At block 220, a barrel disposed in a container may be provided. The container may contain an electrolytic solution and a copper starting pole component. At block 230, a plurality of electrically conductive particles and the article may be positioned within the barrel. Continuing to block 240, one or more copper ions may be separated from at least a portion of the article by electrolysis.

In some examples, the article may be a circuit board having a copper component disposed at least partially thereon. In some examples, the copper component may include a copper foil. In some examples, the article may include a plurality of circuit boards. In some examples, the container may include an electroplating machine.

In some examples, the positioning operation (at block 230) may include placing the circuit board in contact with the plurality of electrically conductive particles and/or the barrel. Some examples may provide for the positioning operation (at block 230) to include placing the article in contact with an inner surface of the barrel. In some examples, the positioning operation (at block 230) may include positioning the article in contact with at least a portion of the plurality of electrically conductive particles and a conductive inner surface of the barrel.

In some examples, the plurality of electrically conductive particles may include lead particles, lead-antimony alloy particles, lead-tin-calcium alloy particles, conductive plastic particles and/or graphite particles. In some examples, the electrolytic solution may include copper sulfate and/or sulfuric acid.

In some examples, the barrel may include an acid-resistive material and/or a thermo-resistive material. In some examples, the barrel may include a plastic barrel having a corrosion-resistant conductive metal material interior wall. In some examples, a nylon plastic and/or ABS plastic barrel may include a lead and/or lead alloy lining. In some examples, the barrel may include a corrosion-resistant metal/metal alloy (e.g., Alloy 20). In some examples, the barrel wall may include substantially round holes that are of a larger diameter than the conductive particles present. For example, if the conductive particles are 3-5 mm in diameter, the wall holes may be 1-2 mm in diameter. After a period of use, the diameter of conductive particles becomes may be reduced due to wear and tear. In such example, the diameter of the holes may be smaller than 1-2 mm to extend the service life of the conductive particles. Over time, the diameter of the conductive particles may be drastically reduced, causing the conductive particles to fall through the holes. Such conductive particles may be removed from the electrolytic solution by filtration, and may be re-recycled.

In some examples, the separating operation (at block 240) may include electrically coupling the barrel to a positive pole of a power source, and electrically coupling the copper starting pole component to a negative pole of the power source. Some examples may also include applying a voltage by the power source. In some examples, the voltage applied may be in a range of approximately 0.2 V to 0.4 V. In some examples, voltages greater than 0.4 V may be applied. In some examples, the voltage applied may depend on the circulation speed of the electrolytic solution (the electrolyte may flow within the electrolytic bath rather than remaining still), the temperature of the electrolytic solution and the amount of impurities in the electrolytic solution. To improve reclaimed copper quality, the ranges of impurity concentrations in the electrolyte may be controlled (e.g., As<7 g/L, Sb<0.7 g/L, Bi<0.5 g/L, Ni<7 g/L) using well-known techniques. Variations of the contents in the electrolytic solution, the circulating speed and the temperature may lead to variation of the electroconductivity of the electrolytic solution, which may lead to variation of the voltage.

In some examples, the barrel may be rotated to facilitate enhanced contact between the article and electrically conductive particles.

In some examples, the article may include one or more non-copper metal components. In such examples, the separating operation (at block 240) may cause separation of the non-copper metal components from the article.

In some examples, the copper starting pole component may include a copper starting pole plate. In some examples, the separated copper ions may be received by the copper starting pole component. In such examples, the non-copper metal components may fall toward a bottom surface of the container. In some examples, the article may include a plurality of articles, where each article may contain at least one component containing or coated with copper.

Figure 3:
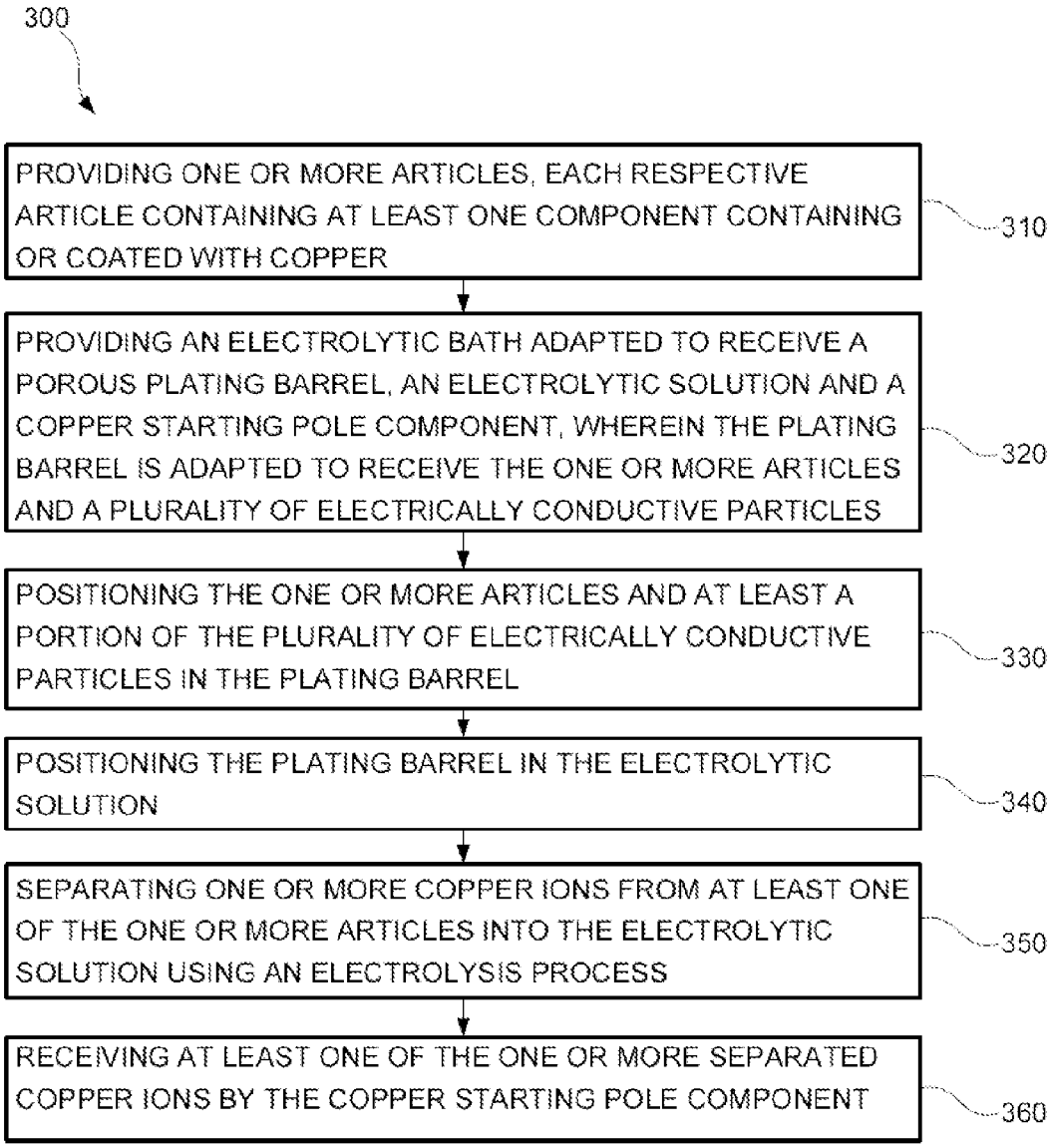
FIG. 3 is a flowchart depicting some example methods of reclaiming metal.

FIG. 3 is a flowchart depicting some example methods 300 of reclaiming metal, in accordance with at least some embodiments of the present disclosure. Example method 300 may include one or more of operations, functions or actions as depicted by blocks 310, 320, 330, 340, 350 and/or 360.

Processing may begin at block 310, by providing one or more articles, each respective article containing at least one component containing or coated with copper. Block 310 may be followed by block 320. At block 320, an electrolytic bath may be provided. The electrolytic bath may be adapted to receive a porous plating barrel, an electrolytic solution and a copper starting pole component. The plating barrel may be adapted to receive the articles and a plurality of electrically conductive particles. At block 330, the articles and at least a portion of the plurality of electrically conductive particles may be positioned in the plating barrel. Continuing to block 340, the plating barrel may be positioned in the electrolytic solution. Block 340 may be followed by block 350. At block 350, one or more copper ions from the articles may be separated into the electrolytic solution using an electrolysis process. Continuing to block 360, at least one of the separated copper ions may be received by the copper starting pole component.

In some examples, the separating operation (at block 350) may include coupling the plating barrel to a positive pole of a power source, and coupling the copper starting pole component to a negative pole of the power source. In such examples, an electrical potential may be applied to facilitate the electrolysis process.

In some examples, the positioning operation (at block 330) may include placing the articles in contact with one or more of the plurality of electrically conductive particles and the plating barrel. In some examples, the positioning operation (at block 340) may include at least partially submerging the article and a portion of the electrically conductive particles in the electrolytic solution.

In some examples, the articles may include circuit boards having a copper foil disposed at least partially thereon. In some examples, the articles may include one or more non-copper metal components. In such examples, the separating step (at block 350) may cause separation of the non-copper metal components from the articles.

Figure 4:
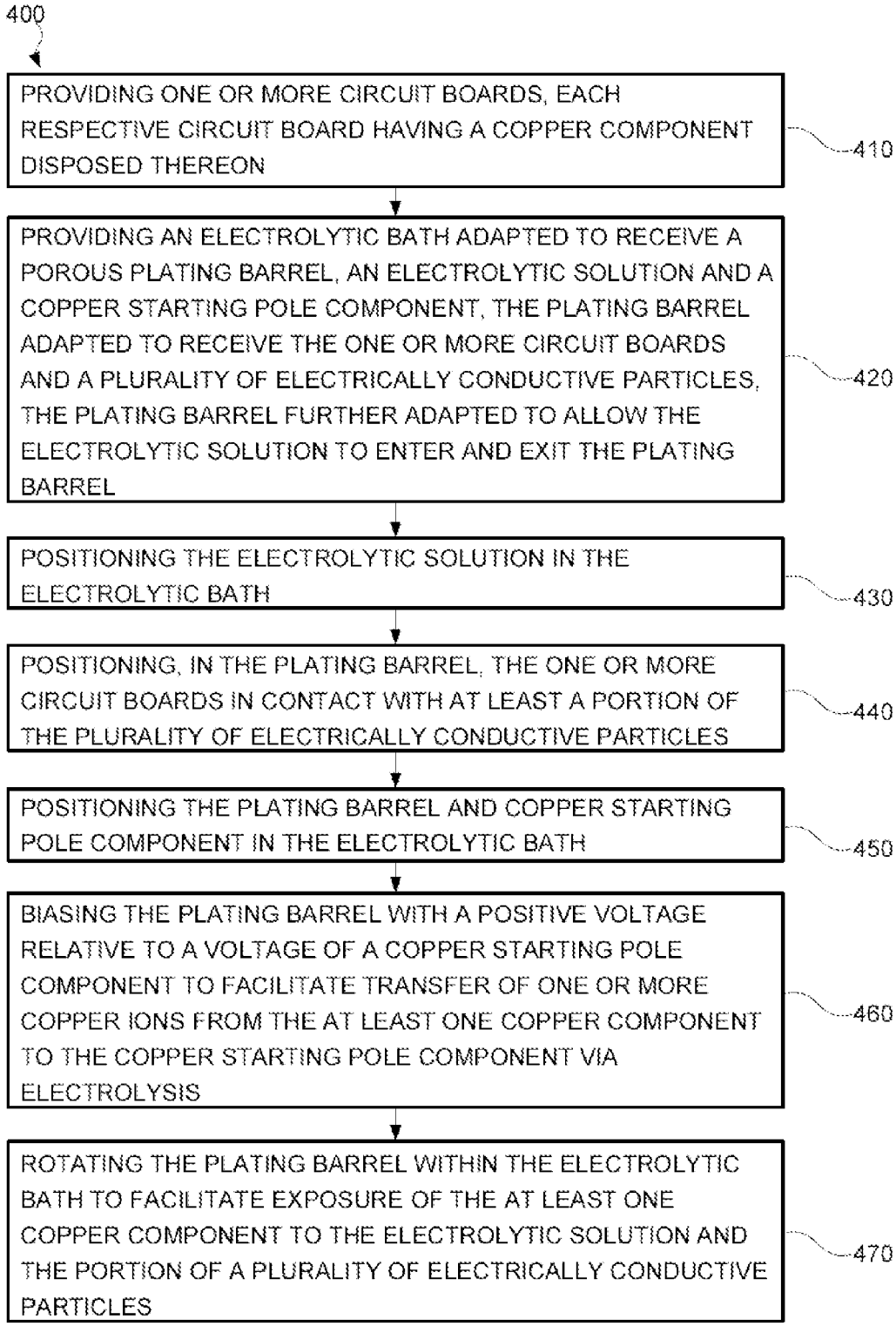
FIG. 4 is a flowchart depicting some example methods of reclaiming metal.

FIG. 4 is a flowchart depicting some example methods 400 of reclaiming metal, in accordance with at least some embodiments of the present disclosure. Example method 400 may include one or more of operations, functions or actions as depicted by blocks 410, 420, 430, 440, 450, 460 and/or 470.

Processing may begin at block 410, by providing one or more circuit boards, each respective circuit board having a copper component disposed thereon. Block 410 may be followed by block 420. At block 420, an electrolytic bath may be provided. The electrolytic bath may be adapted to receive a porous plating barrel, an electrolytic solution and a copper starting pole component. The plating barrel may be adapted to receive the circuit boards and a plurality of electrically conductive particles. The plating barrel may also be adapted to allow the electrolytic solution to enter and exit the plating barrel. At block 430, the electrolytic solution may be positioned in the electrolytic bath. Continuing to block 440, the circuit boards may be positioned in the plating barrel such that the circuit boards are in contact with at least a portion of the plurality of electrically conductive particles. Block 440 may be followed by block 450. At block 450, the plating barrel and copper starting pole component may be positioned in the electrolytic bath. Continuing to block 460, the plating barrel may be biased with a positive voltage relative to a voltage of a copper starting pole component to facilitate transfer of one or more copper ions from the copper component(s) to the copper starting pole component via electrolysis. Continuing to block 470, the plating barrel may be rotated within the electrolytic bath to facilitate exposure of the copper component(s) to the electrolytic solution and the portion of a plurality of electrically conductive particles. In some examples, the plating barrel may rotate one revolution per minute. Other rotation speeds may also be used.

In some examples, the biasing operation (at block 460) may include coupling the plating barrel to a positive pole of a power source, and coupling the copper starting pole component to a negative pole of the power source. In such examples, a voltage may be applied by the power source. In some examples, a voltage may be applied until visual inspection indicates all (or substantially all) copper has been removed. Such a visual inspection may occur while the circuit boards are positioned in the plating barrel, or while some or all of the circuit boards are removed from the plating barrel.

In some examples, the positioning operation (at block 440) may include positioning, in the plating barrel, the circuit boards in contact with a conductive inner surface of the plating barrel.

Figure 5:
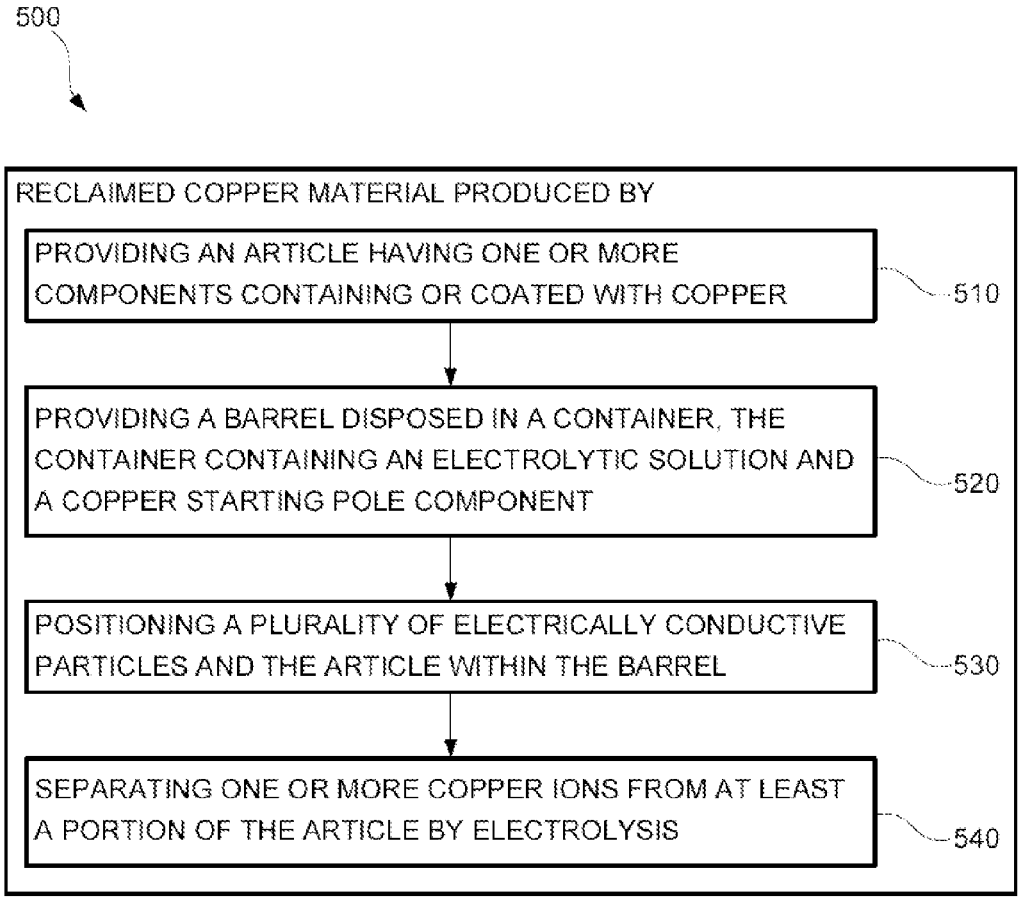
FIG. 5 is a diagram depicting some example reclaimed copper materials.
Figure 6:
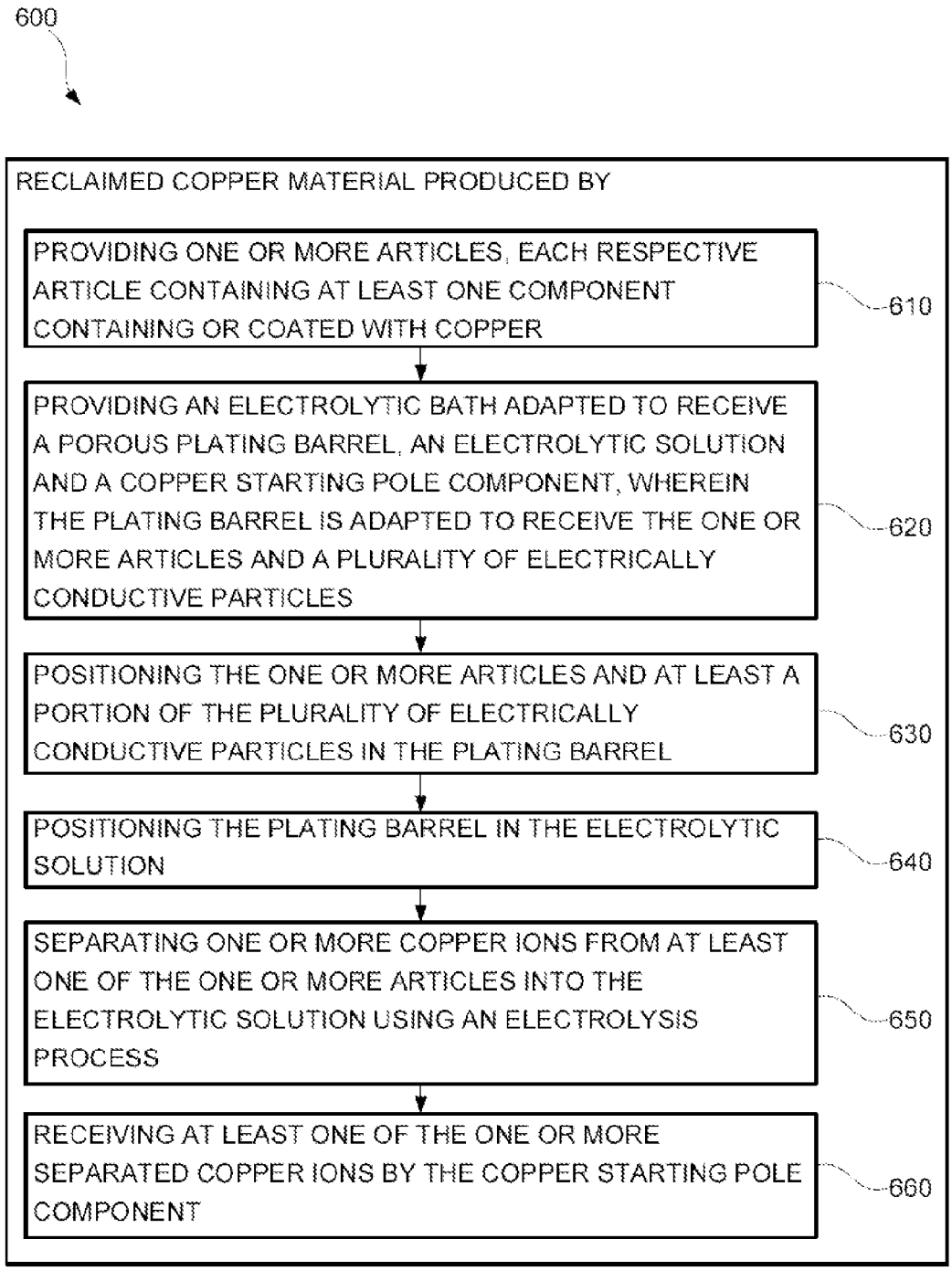
FIG. 6 is a diagram depicting some example reclaimed copper materials.
Figure 7:
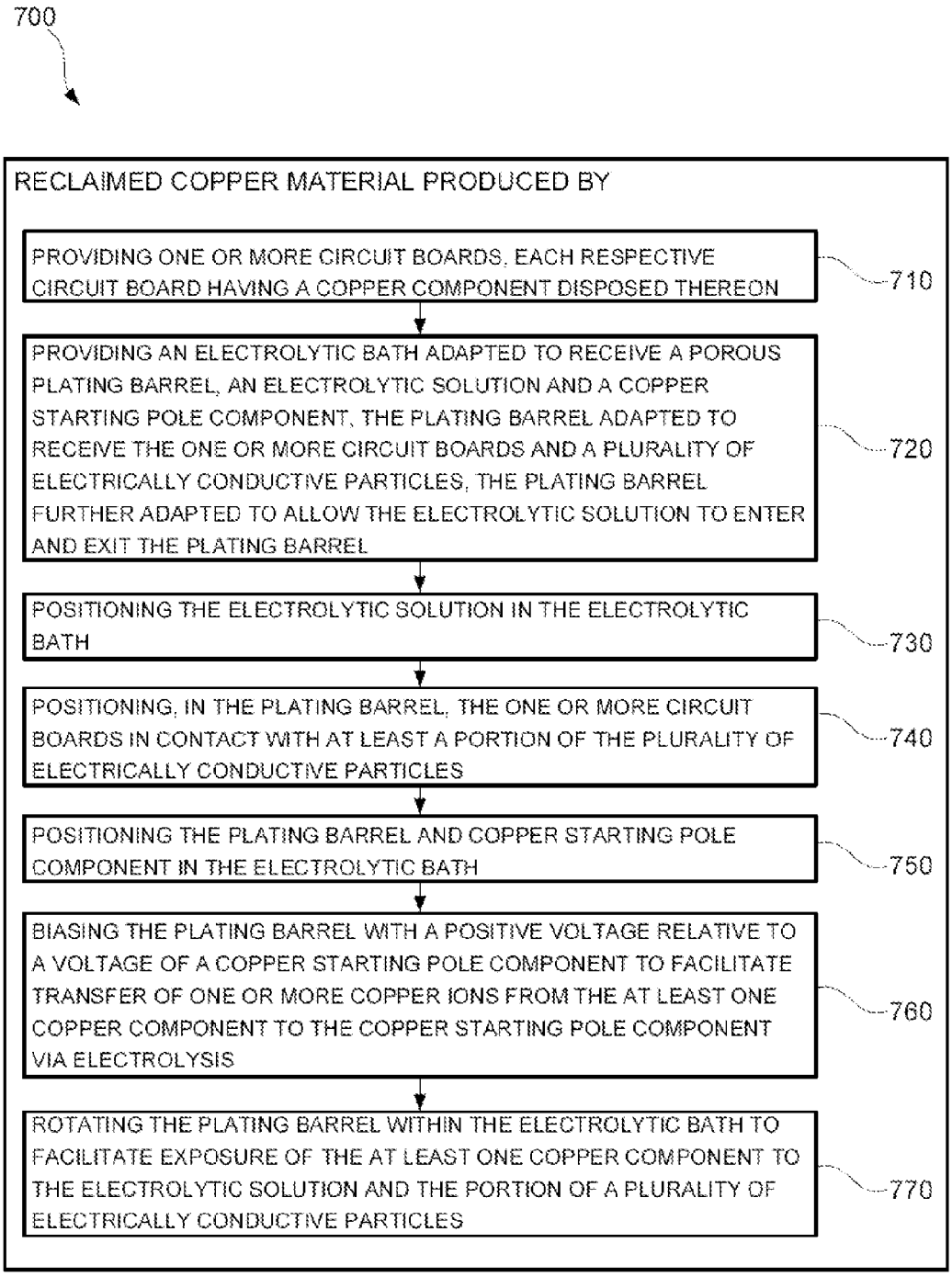
FIG. 7 is a diagram depicting some example reclaimed copper materials.

FIGS. 5, 6 and 7 depict example reclaimed copper materials produced by the methods described herein. Specifically, FIG. 5 depicts example reclaimed copper materials produced by the example process depicted in FIG. 2. Similarly, FIG. 6 depicts example reclaimed copper materials produced by the example process depicted in FIG. 3. Additionally, FIG. 7 depicts example reclaimed copper materials produced by the example process depicted in FIG. 4.

Figure 8A:
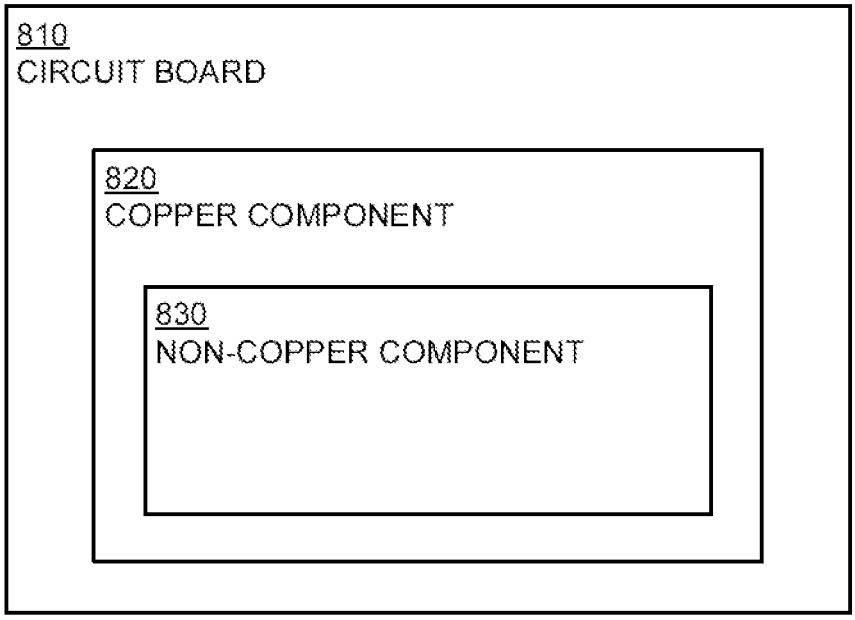
FIGS. 8A and 8B are diagrams depicting some example articles containing at least one component containing or coated with copper.
Figure 8B:
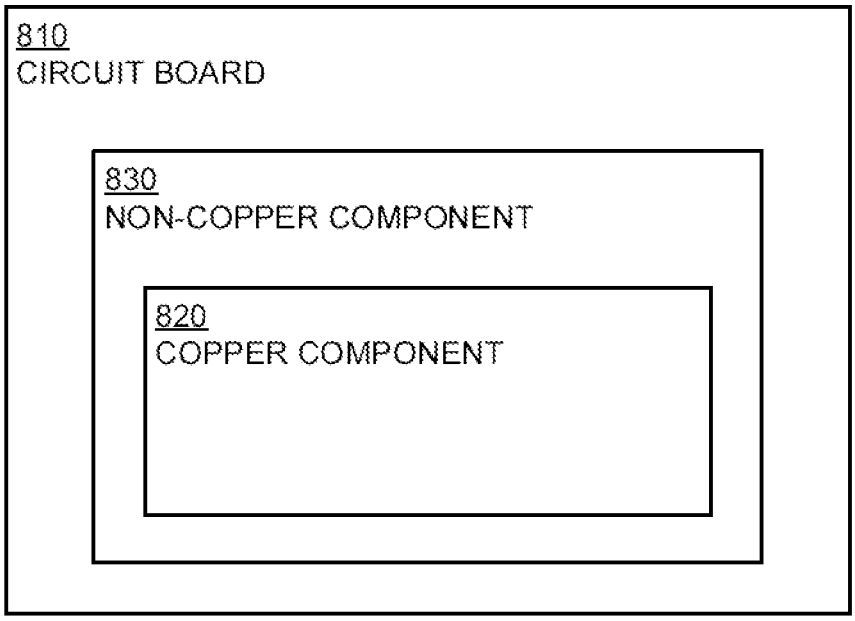

FIGS. 8A and 8B depict example articles as circuit boards having one or more components containing or coated with copper, arranged in accordance with at least some embodiments of the present disclosure. As depicted in FIGS. 8A and 8B, the circuit board 810 may have copper component(s) 820 and/or non-copper component(s) 830 disposed thereon. In FIG. 8A, a non-copper component 830 is disposed upon a copper component 820. In FIG. 8B, a copper component 820 is disposed upon a non-copper component 830. Other component arrangements may also be possible.

Figure 9A:
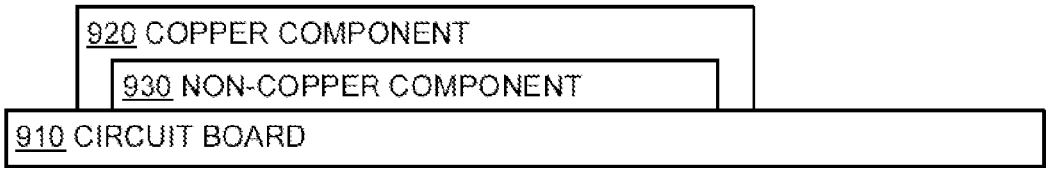
FIGS. 9A, 9B, 9C and 9D are diagrams depicting cross-section views of example articles containing at least one component containing or coated with copper; all arranged in accordance with at least some embodiments of the present disclosure.
Figure 9B:
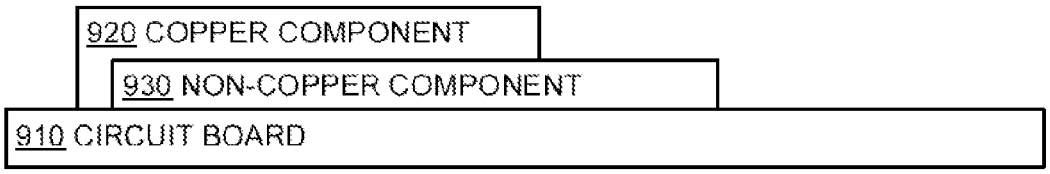
Figure 9C:
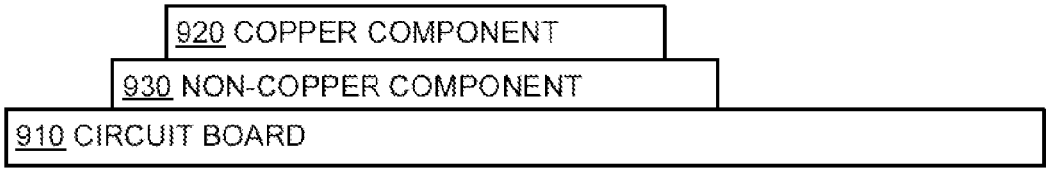
Figure 9D:
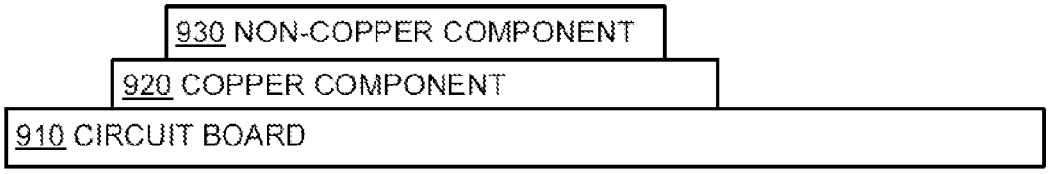

FIGS. 9A, 9B, 9C and 9D depict cross-section views of example articles as circuit boards having one or more components containing or coated with copper, arranged in accordance with at least some embodiments of the present disclosure. In FIGS. 9A, 9B and 9C, a copper component 920 is disposed upon a non-copper component 930 in various arrangements. FIG. 9A shows an example where the copper component 920 complete covers a non-copper component 930. FIGS. 9B and 9C shows an example where the copper component 920 partially covers a non-copper component 930. FIG. 9D shows an example where the copper component 920 is partially covered by a non-copper component 930. Other component arrangements may also be possible.

EXAMPLES

Example 1

Reclaiming Copper from Circuit Boards

Multiple copper-clad circuit boards are provided, obtained from discarded electronics waste. An electrolysis container is provided containing an aqueous solution of 45 g/L copper sulfate and 150 g/L of sulfuric acid, as well as a copper starting pole. The circuit boards are placed in a porous ceramic lead-lined plating barrel along with lead electrically-conductive particles. The barrel is placed within the container such that the aqueous solution penetrates the porous barrel and contacts the circuit boards.

A voltage of 0.3 V is applied for one hour, during which copper ions are released from the circuit boards and deposited on the copper starting pole. A visual inspection of the circuit board confirms that copper is no longer visible on the circuit boards.

Example 2

Reclaiming Copper, Nickel, and Silver from Circuit Boards

Multiple printed circuit boards ("PCBs") are provided, containing copper, nickel, and silver components. An electrolysis container is provided containing an aqueous solution of 50 g/L copper sulfate and 100 g/L of sulfuric acid, as well as a copper starting pole. The circuit boards are placed in a porous ceramic lead-lined plating barrel along with graphite electrically-conductive particles. The barrel is placed within the container such that the aqueous solution penetrates the porous barrel and contacts the circuit boards.

A voltage of 0.45 V is applied for two hours, during which copper ions are released from the circuit boards and deposited on the copper starting pole. A visual inspection of the circuit board confirms that copper, nickel, and silver are no longer visible on the circuit boards. Nickel, being more electrically active than copper, is isolated from the aqueous solution by electrolyte purification. Silver, being less electrically active than copper, is isolated as a silt at the bottom of the electrolytic bath.

Example 3

Reclaiming Copper from Circuit Boards

Multiple copper-clad circuit boards are provided, obtained from discarded electronics waste. An electrolysis container is provided containing an aqueous solution of 45 g/L copper sulfate and 150 g/L of sulfuric acid, as well as a copper starting pole. The aqueous solution is approximately 65° C. Additives are added to the aqueous solution, including 30-40 g/L of glue (e.g., bone glue and gelatin), 30-40 g/L of thiourea, and 13-30 g/L of casein. In addition, glues on the surface of the copper-clad circuit boards are removed by physical and/or chemical methods prior to electrolysis. The circuit boards are placed in a porous lead-lined plating barrel along with lead electrically-conductive particles. The barrel is placed within the container such that the aqueous solution penetrates the porous barrel and contacts the circuit boards.

A voltage of 0.3 V is applied for eight hours, during which copper ions are released from the circuit boards and deposited on the copper starting pole. A visual inspection of the circuit board confirms that copper is no longer visible on the circuit boards.

The herein described subject matter sometimes illustrates different components contained within, or connected with, different other components. It is to be understood that such depicted architectures are merely examples, and that in fact many other architectures may be implemented which achieve the same functionality. In a conceptual sense, any arrangement of components to achieve the same functionality is effectively "associated" such that the desired functionality is achieved. Hence, any two components herein combined to achieve a particular functionality may be seen as "associated with" each other such that the desired functionality is achieved, irrespective of architectures or intermedial components. Likewise, any two components so associated may also be viewed as being "operably connected", or "operably coupled", to each other to achieve the desired functionality, and any two components capable of being so associated may also be viewed as being "operably couplable", to each other to achieve the desired functionality. Specific examples of operably couplable include but are not limited to physically mateable and/or physically interacting components and/or wirelessly interactable and/or wirelessly interacting components and/or logically interacting and/or logically interactable components.

With respect to the use of substantially any plural and/or singular terms herein, those having skill in the art may translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A method of reclaiming metal, the method comprising:

providing an article having one or more components containing or coated with copper;

providing a barrel disposed in a container, the container containing an electrolytic solution and a copper starting pole component;

positioning a plurality of electrically conductive particles and the article within the barrel; and separating one or more copper ions from at least a portion of the article by electrolysis.

2. The method of claim 1, wherein the article comprises one or more circuit boards having a copper component disposed at least partially thereon.

3. The method of claim 2, wherein the copper component comprises a copper foil.

4. The method of claim 2, wherein the positioning step comprises placing the circuit board in contact with one or more of the plurality of electrically conductive particles and the barrel.

5. The method of claim 1, wherein the positioning step comprises placing the article in contact with an inner surface of the barrel.

6. The method of claim 1, wherein the positioning step comprises positioning the article in contact with at least a portion of the plurality of electrically conductive particles and a conductive inner surface of the barrel.

7. The method of claim 1, wherein the container comprises an electroplating machine.

8. The method of claim 1, wherein the plurality of electrically conductive particles comprises one or more of lead particles, lead-antimony alloy particles, lead-tin-calcium alloy particles, conductive plastic particles and graphite particles.

9. The method of claim 1, wherein the electrolytic solution comprises one or more of copper sulfate and sulfuric acid.

10. The method of claim 1, wherein the barrel is comprised of one or more of an acid-resistive material and a thermo-resistive material.

11. The method of claim 1, wherein the separating step comprises, electrically coupling the barrel to a positive pole of a power source;

electrically coupling the copper starting pole component to a negative pole of the power source; and applying a voltage by the power source.

12. The method of claim 11, wherein the voltage is about 0.2 V to about 0.4 V.

13. The method of claim 1, wherein the copper starting pole component comprises a copper starting pole plate.

14. The method of claim 1, further comprising:

rotating the barrel about an axis to facilitate enhanced contact between at least a portion of the article and at least a portion of the plurality of electrically conductive particles.

15. The method of claim 1, wherein the article further includes one or more non-copper metal components; and wherein separating one or more copper ions from at least a portion of the article by electrolysis causes separation of the one or more non-copper metal components from the article.

16. The method of claim 15, wherein the one or more separated copper ions are received by the copper starting pole component; and wherein the one or more non-copper metal components fall to a bottom surface of the container.

17. The method of claim 1, wherein the article comprises a plurality of articles, each respective article containing at least one component containing or coated with copper.

18. A method of reclaiming metal, the method comprising:

providing one or more articles, each respective article containing at least one component containing or coated with copper;

providing an electrolytic bath adapted to receive a porous plating barrel, an electrolytic solution and a copper starting pole component, wherein the plating barrel is adapted to receive the one or more articles and a plurality of electrically conductive particles;

positioning the one or more articles and at least a portion of the plurality of electrically conductive particles in the plating barrel;

positioning the plating barrel in the electrolytic solution;

separating one or more copper ions from at least one of the one or more articles into the electrolytic solution using an electrolysis process; and receiving at least one of the one or more separated copper ions by the copper starting pole component.

19. The method of claim 18, wherein the separating step comprises:

coupling the plating barrel to a positive pole of a power source;

coupling the copper starting pole component to a negative pole of the power source; and applying an electrical potential to facilitate the electrolysis process.

20. The method of claim 18, wherein the one or more articles comprises one or more circuit boards having a copper foil disposed at least partially thereon.

21. The method of claim 18, wherein the positioning the articles and electrically conductive particles step comprises placing the one or more articles in contact with one or more of the plurality of electrically conductive particles and the plating barrel.

22. The method of claim 18, wherein positioning the plating barrel step comprises at least partially submerging the article and the portion of the electrically conductive particles in the electrolytic solution.

23. The method of claim 18, wherein the one or more articles further includes one or more non-copper metal components; and wherein the separating step causes separation of the one or more non-copper metal components from the one or more articles.

24. A method of reclaiming metal, the method comprising:

providing one or more circuit boards, each respective circuit board having a copper component disposed thereon;

providing an electrolytic bath adapted to receive a porous plating barrel, an electrolytic solution and a copper starting pole component, the plating barrel adapted to receive the one or more circuit boards and a plurality of electrically conductive particles, the plating barrel further adapted to allow the electrolytic solution to enter and exit the plating barrel;

positioning the electrolytic solution in the electrolytic bath;

positioning, in the plating barrel, the one or more circuit boards in contact with at least a portion of the plurality of electrically conductive particles;

positioning the plating barrel and copper starting pole component in the electrolytic bath;

biasing the plating barrel with a positive voltage relative to a voltage of a copper starting pole component to facilitate transfer of one or more copper ions from the at least one copper component to the copper starting pole component via electrolysis; and rotating the plating barrel within the electrolytic bath to facilitate exposure of the at least one copper component to the electrolytic solution and the portion of a plurality of electrically conductive particles.

25. The method of claim 24, wherein the biasing step comprises:

coupling the plating barrel to a positive pole of a power source;

coupling the copper starting pole component to a negative pole of the power source; and applying a voltage by the power source.

26. The method of claim 24, wherein the positioning the one or more circuit boards step further comprises positioning, in the plating barrel, the one or more circuit boards in contact with a conductive inner surface of the plating barrel.

* * * * *